United States Patent [19]

Sugiura et al.

[11] Patent Number: 4,749,092

[45] Date of Patent: Jun. 7, 1988

[54] SATURATED POLYESTER RESIN BOTTLE

[75] Inventors: Hiroaki Sugiura; Yuko Onoda; Shinji Shimada, all of Tokyo, Japan

[73] Assignee: Yoshino Kogyosho Co, Ltd., Tokyo, Japan

[21] Appl. No.: 77,977

[22] Filed: Jul. 27, 1987

Related U.S. Application Data

[63] Continuation of Ser. No. 253,632, filed as PCT JP79/00207, Aug. 8, 1979, published as WO81/00390, Feb. 19, 1981, abandoned.

[51] Int. Cl.[4] ..... B65D 1/02

[52] U.S. Cl. ..... 215/1 C

[58] Field of Search ..... 215/1 C

[56] References Cited

U.S. PATENT DOCUMENTS

| | | | |
|---|---|---|---|
| D. 29,032 | 7/1898 | Schies | D9/400 |
| D. 142,746 | 10/1945 | Stackpole | D9/398 |
| D. 218,284 | 8/1970 | Du Pree | D9/400 |
| D. 238,552 | 1/1976 | Edwards | D9/392 |
| 3,184,524 | 5/1965 | Whiteford . | |
| 3,643,829 | 2/1972 | Lachner | 215/1 C |
| 3,733,309 | 5/1973 | Wyeth et al. | 215/1 C X |
| 3,923,178 | 12/1975 | Welker | 215/1 C |
| 4,233,022 | 11/1980 | Brady et al. | 215/1 C X |

FOREIGN PATENT DOCUMENTS

| | | |
|---|---|---|
| 40-4591 | 2/1965 | Japan . |
| 45-10749 | 4/1970 | Japan . |
| 45-14175 | 5/1970 | Japan . |
| 45-28491 | 8/1970 | Japan . |
| 45-31626 | 9/1970 | Japan . |
| 45-31625 | 9/1970 | Japan . |
| 52-114956 | 2/1977 | Japan . |
| 54-30654 | 2/1979 | Japan . |
| 7906151 | 3/1980 | Netherlands . |
| 349923 | 12/1960 | Switzerland . |
| 1207017 | 9/1970 | United Kingdom . |

*Primary Examiner*—Donald F. Norton

*Attorney, Agent, or Firm*—Parkhurst & Oliff

[57] ABSTRACT

The present invention relates to a saturated polyester resin bottle made thin by biaxial orientation and comprising a trunk portion formed to have a regular polygonal cross section consisting of a plurality of generally upright flat sides separated by vertically oriented ribs. When the interior of the bottle is subjected to a vacuum, the flat sides uniformly warp radially inwardly to accommodate the vacuum without detracting from the appearance of the bottle.

6 Claims, 2 Drawing Sheets

SATURATED POLYESTER RESIN BOTTLE

This is a continuation of application Ser. No. 253,632 filed as PCT JP79/00207 on Aug. 8, 1979, published as WO81/00390 on Feb. 19, 1981, now abandoned.

TECHNICAL FIELD

The present invention relates to a molded saturated polyester resin bottle, and more particularly to a thin-walled bottle made thin by biaxial orientation and having a specific bottle cross section to accommodate evacuation of the bottle interior without detracting from the appearance of the bottle.

BACKGROUND OF THE INVENTION

Lightweight bottles made of a saturated polyester resin have recently become popular because of their tendency to resist deterioration and to withstand attack of the liquid contained therein. Moreover, saturated polyester resin bottles are widely used because they do not generate poisonous gasses when burned. However, these bottles typically are very lightweight and thin-walled and thus do not satisfactorily resist dimensional changes when their interior is subjected to vacuum conditions. For example, when a saturated polyester resin bottle is filled and sealed with a hot liquid such as a liquid sterilized at a high temperature, subsequent contraction of the liquid upon cooling results in an evacuation of the bottle which tends to deform the bottle walls. Such deformation typically concentrates at weaker portions of the bottle walls resulting in an irregular and commercially unacceptable appearance of the bottle. Moreover, if the deformation occurs in the vicinity of attachment of a label to the bottle, the appearance of the label is also adversely affected.

BRIEF SUMMARY OF THE INVENTION

The present invention relates to a lightweight and thinwalled bottle formed from a saturated polyester resin and made thin by biaxial orientation, wherein the bottle walls are configured to accommodate evacuation of the bottle without deleterious changes in the bottle appearance. More specifically, the bottle is formed to have a vertically extending trunk portion configured to include a generally regular polygonal cross section. The polygonal cross section comprises a plurality of identical upstanding flat sides angularly oriented with respect to each other and separated by vertically extending ribs. Upon evacuation of the bottle, these flat sides warp uniformly inwardly so that the vacuum is accommodated in a uniform manner without adversely altering the appearance of the bottle.

BRIEF DESCRIPTION OF THE DRAWINGS

The accompanying drawings illustrate the invention. In such drawings.

DETAILED DESCRIPTION OF THE INVENTION

Figure 1:
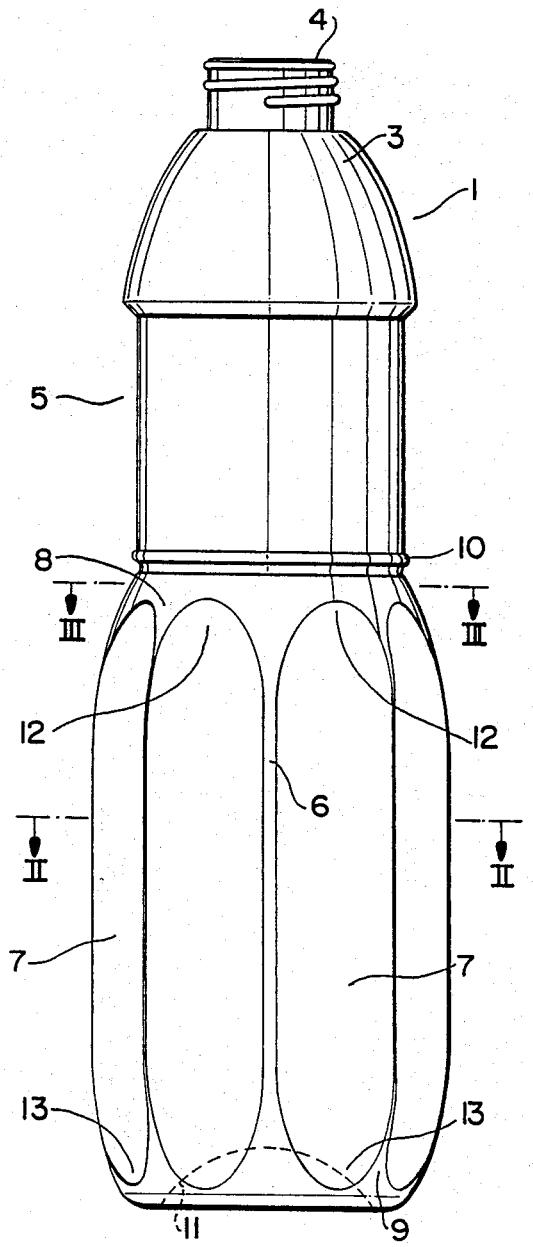
FIG. 1 is a side elevation of a bottle of this invention.

A bottle 1 of a saturated polyester resin material is shown in FIG. 1 and comprises a generally upstanding cylindrical body for receiving and supporting a suitable fluid or liquid. As shown, the bottle 1 comprises a trunk portion 2 having its lower end closed by a bottom wall 11. The trunk portion 2 extends upwardly from the bottom wall 11 and terminates in a radially outwardly projecting annular flange 10. In turn, the flange 10 is formed integrally with an upwardly extending smooth-surfaced cylindrical portion 5 adapted for affixation of a label or the like for identifying the contents of the bottle 1. The upper end of the cylindrical portion 5 blends into an upwardly and radially inwardly sloping bottle shoulder 3 which terminates in a mouth 4 including external threads for reception of a bottle cap (not shown).

Figure 2:
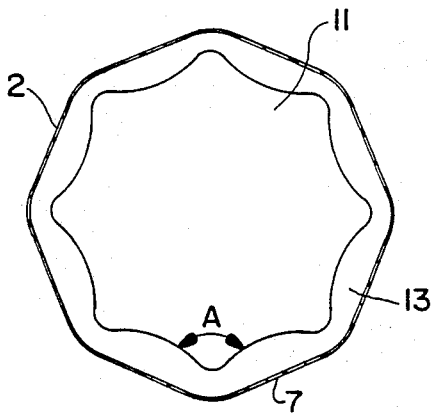
FIG. 2 is a vertical section taken along line II—II of FIG. 1 illustrating the bottle before and after evacuation.
Figure 3:
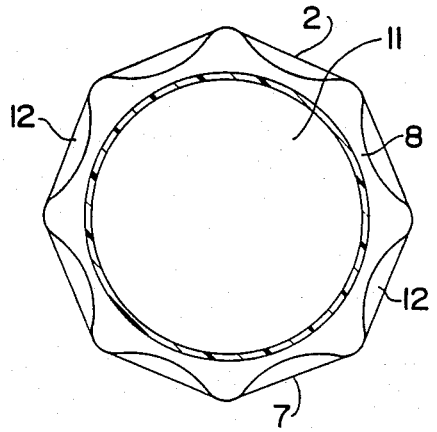
FIG. 3 is a vertical section taken along line III—III of FIG. 1.

The trunk portion 2 of the bottle is specifically configured to accommodate dimensional changes of the bottle upon evacuation of the bottle interior without adversely affecting the exterior appearance of the bottle. As shown in FIGS. 1–3, the trunk portion 2 has a lower flared portion 9 which extends angularly and radially upwardly and outwardly from the bottle bottom wall 11. This lower flared portion 9 blends into a plurality of regularly-spaced flat tongue-shaped portions 13 which extend upwardly to become upstanding flat sides 7 separated by vertically oriented ribs 6. Near the top of the trunk portion 2, these flat sides 7 merge into upper tongue-shaped portions 12 and further into an upper flared portion 8 which extends upwardly and radially inwardly toward the flange 10.

Thus, the trunk portion 2 comprises primarily the plurality of flat sides 7 forming a generally regular polygonal cross section. These flat sides 7 constitute the portion of the bottle 1 subject to deformation upon evacuation of the bottle, since all other bottle surfaces are angularly oriented with respect to radially inwardly directed deformation forces. That is, the ribs 6, the flared portions 12 and 13, the flange 10, the cylindrical portion 5, and the shoulder 3 are all configured to resist evacuation deformation as compared with the flat sides 7. Accordingly, when the bottle 1 is subjected to an internal vacuum, the flat sides 7 uniformly warp radially inwardly to accommodate the vacuum. Importantly, this uniform warping of the flat sides 7 does not detract from the appearance of the bottle 1, and does not affect the appearance of the label (not shown) which may be attached to the cylindrical portion 5. Of course, when the vacuum is released, the warped sides 7 return to their initial flat shapes due to the elasticity of the bottle material.

Warping of the flat sides 7 upon evacuation of the bottle 1 serves to increase the overall strength of the bottle by altering the angular relationship between the flat sides 7 with respect to radially inwardly directed deformation forces. That is, as illustrated in FIG. 2, the flat sides 7 forming the polygonal cross section are oriented with respect to each other at angle "A". As the flat sides 7 warp inwardly about their vertical center lines, the angle "A" decreases, and thereby causing the overall outside diameter of the trunk portion to decrease, to inversely increase the resistance of the trunk portion 2 to deformation. FIG. 2 illustrates a cross-section along lines II—II both before and after evacuation. Moreover, the tongue-shaped portions 12 and 13 merge into the upright flat sides 7 to substantially enlarge the effective longitudinal length of the flat sides 7, thus allowing these sides 7 to warp over an elongated range in the longitudinal direction. Conveniently, these tongue-shaped portions 12 and 13 are made to have their edges curved so that no stress concentration occurs.

Figure 4:
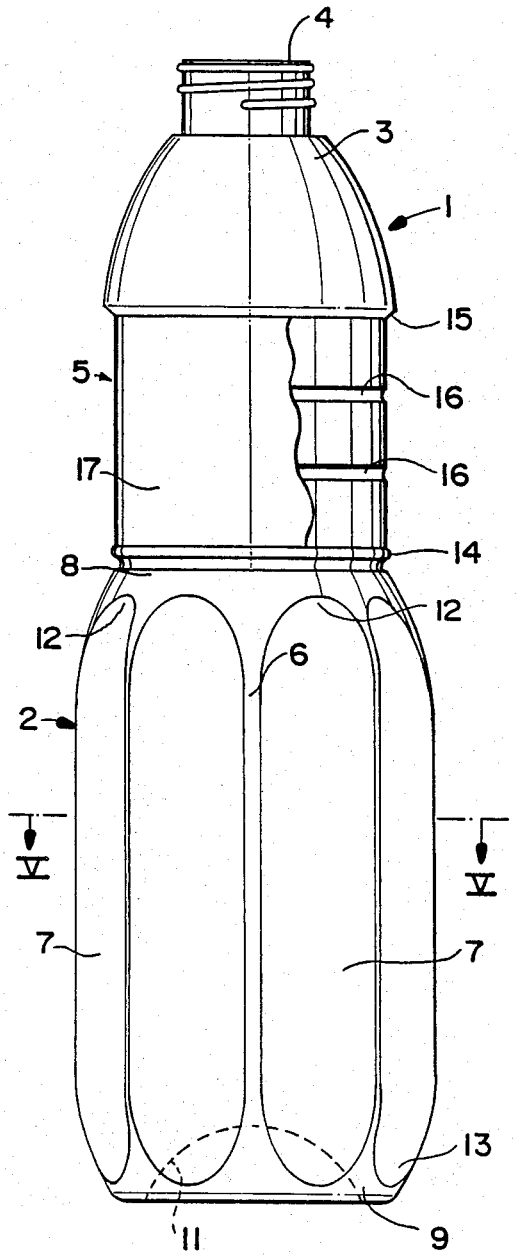
FIG. 4 is a side elevation of a bottle according to an alternate embodiment of the invention.
Figure 5:
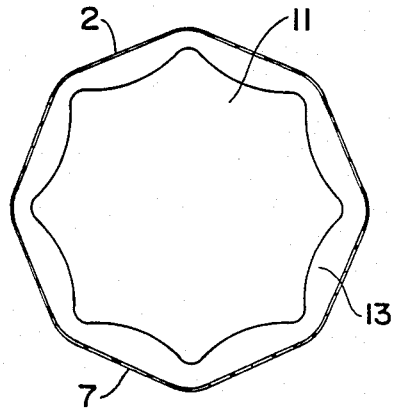
FIG. 5 is a vertical section taken along line V—V of FIG. 4.

A modified embodiment of a saturated polyester resin bottle of this invention is shown in FIGS. 4 and 5, with portions of the bottle common to the embodiment of FIGS. 1-3 being referred to with common reference numerals. As shown, the cylindrical portion 5 of the bottle 1 blends at its upper and lower ends respectively with annular projections 15 and 14. The cylindrical portion 5 also includes two or more annular grooves 16 to improve the strength of the cylindrical portion 5. A label 17 is affixed to the cylindrical portion 5 covering the groove 16. The remaining construction and operation of this latter embodiment is similar to that of the embodiment of FIGS. 1-3.

When the bottle 1 is evacuated, the resulting vacuum is absorbed in the upright flat portions 7 of the trunk portion 2. The grooves 16 assure that no deformation occurs in the cylindrical portion 5 so that the label 17 is prevented from deforming in shape or peeling off.

I claim:

1. A biaxially oriented container comprising:

a mouth;

a first portion wider than said mouth and connected to and lying below said mouth;

a second portion wider than said first portion and connected to and lying below said first portion, said second portion having an outwardly curving upper shoulder section and an inwardly curving lower end and defining on its face a plurality of vertical sides, adjacent such sides each being joined without intermediary to define a single relatively rigid rib and a base connected to and situated under said second portion, said sides being elongated, substantially flat in shape and terminating at their opposite ends in tongue-shaped portions, and intersecting one another at said ribs to form substantially equal angles between adjacent sides, said sides extending from said upper shoulder section to said lower end such that said tongue-shaped portions of said side angle inwardly at their upper and lower ends in conformity with and over a substantial portion of the axial extent of said shoulder and said lower end, respectively, of said second portion, the periphery of said second portion as viewed along a longitudinal axis of the container being polygonal in form and defining a diameter, said periphery being defined substantially only by said vertical sides, said second portion being constructed and arranged such that said sides flex inwardly in response to a reduction in internal pressure and said inward deflection further increases the rigidity of said ribs by decreasing the angle between each adjacent side, said inward deflection changing the shape of the periphery of said second portion as viewed along the longitudinal axis of said container by substantially reducing the diameter of said second portion and changing the shape of the periphery of said second portion as viewed along the longitudinal axis of said container to form a series of inwardly bowed arcuate sections separated by a series of ribs, the midpoint of said flat sides being the center of said inwardly bowed arcuate sections, the periphery of said second portion as viewed along the longitudinal axis of said container having no straight sections during deflection.

2. A container in accordance with claim 1, wherein said base is connected to said lower end of said second portion and angles upwardly and inwardly of said second portion to define a semispherical depression in the base of said container.

3. A container in accordance with claim 1, wherein said first portion is comprised of an annular section which extends upwardly from said shoulder section of said second portion and defines a plurality of horizontally spaced grooves on its face.

4. A container in accordance with claim 1, wherein said container is made of a polyester resin and comprised of thin walls.

5. A container in accordance with claim 1 wherein an annular bead surrounds a lower end of said first portion and lies slightly above said second portion.

6. A biaxially oriented container comprising:

a mouth;

a trunk portion having an axial length erected from a bottom wall and interposed between said bottom wall and said mouth, at least part of said trunk portion defining an operating portion;

said operating portion having upper and lower portions terminating at respective ends of said operating portion in circular cross-sections and interconnected by an intermediate portion;

said intermediate portion having a constant polygonal cross-section defined substantially only by a plurality of flat side walls, adjacent such side walls being joined at adjacent edges in the axial direction without intermediary to define a single rib, said ribs collectively defining vertices of the polygonal cross-section such that a diameter of an inscribed circle defined by the polygonal is greater than the diameters of the circular cross-sections at the respective ends of the operating portion, said vertices defining a circumscribed circle;

each side of said plurality of flat side walls defining and terminating in tongue-shaped portions, said upper and lower portions of said operating portion having continuously decreasing cross-sectional areas from the intermediate portion to their respective terminating ends to define a tapered shape, said tongue-shaped portions of said flat side walls extending from said intermediate portion substantially into said upper and lower portions such that said tongue-shaped portions taper in conformance with said upper and lower portions and define a substantial portion thereof;

said flat side walls and adjacent ribs being adapted to elastically deform inward upon partial evacuation of said container such that said inscribed circle defined by said polygon and said circumscribed circle defined by said vertices substantially reduce in diameter, thereby increasing the rigidity of said intermediate portion and said upper and lower portions.

* * * * *